US006082560A

United States Patent [19]

Timm

[11] Patent Number: 6,082,560

[45] Date of Patent: Jul. 4, 2000

[54] CLOSET ORGANIZER SUSPENSION SYSTEM

[76] Inventor: Russell D. Timm, 136 Hempell Ct., Summerville, S.C. 29483

[21] Appl. No.: 09/262,624

[22] Filed: Mar. 5, 1999

[51] Int. Cl.[7] ..... A47F 5/00

[52] U.S. Cl. ..... 211/90.01; 211/90.02; 211/90.04; 108/152

[58] Field of Search ..... 211/90.01, 90.02, 211/90.03, 90.04; 108/152

[56] References Cited

U.S. PATENT DOCUMENTS

| | | | |
|---|---|---|---|
| 2,163,861 | 6/1939 | White . | |
| 2,205,193 | 6/1940 | Goldman . | |
| 4,685,575 | 8/1987 | Kulbersh | 211/90.02 |
| 4,928,833 | 5/1990 | Huizenga . | |
| 5,176,266 | 1/1993 | Gillet | 211/90.04 |
| 5,472,103 | 12/1995 | Merl | 211/90.04 X |
| 5,655,740 | 8/1997 | Lazarus | 211/90.02 X |

FOREIGN PATENT DOCUMENTS

| | | | |
|---|---|---|---|
| 650684 | 1/1963 | Italy | 211/90.04 |
| 76187 | 1/1933 | Sweden | 211/90.01 |

*Primary Examiner*—Robert W. Gibson, Jr.
*Attorney, Agent, or Firm*—Hugh D. Jaegar

[57] ABSTRACT

A closet organizer suspension system which uses shelving supported by notched vertical poles in conjunction with tension rods screwed upwardly into the studs and/or top plates of walls, and custom hardware and accessories. Also used are metal tension straps secured to the top plates. This configuration allows a heavier load to be transferred to the studs and top plates rather than the drywall being used to support the shelving loads. The closet organizer suspension system allows the user to custom configure its components to provide maximum use of allotted space.

6 Claims, 14 Drawing Sheets

CLOSET ORGANIZER SUSPENSION SYSTEM

CROSS REFERENCES TO CO-PENDING APPLICATIONS

None.

BACKGROUND OF THE INVENTION

1. Field of the Invention

The present invention is for a closet organizer suspension system and hardware, and more particularly, a closet organizer suspension system having notched vertical poles, shelves, tension rods, hooked tension rod brackets, and hanging rods which can be assembled to create storage arrangements tailored to a variety of needs.

2. Description of the Prior Art

There is no prior art which discloses a closet organizer suspension system which uses the specially designed shelf supports in conjunction with tension rods which support shelving, rod hangers and the like from the studs in the wall. The shelf load capacity is increased greatly over current closet organizer suspension systems by using the studs and/or top plates of the wall to bear the weight of the shelf and its load. With an increased shelf load, the suspended shelf is forced against the wall. The present invention uses tension rods which are secured above and/or through the shelving and supports, whereas the organizer systems on the market support the shelving from the underside. With an increased shelf load, the shelving systems on the market pull away from the wall.

SUMMARY OF THE INVENTION

The general purpose of the present invention is a closet organizer suspension system.

According to one embodiment of the present invention, there is provided shelving, notched vertical poles, tension rods, shelf supports, custom hardware and accessories. There is also provided adaptive hardware which allows the support method and properties to be adapted for use with existing wire shelving.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
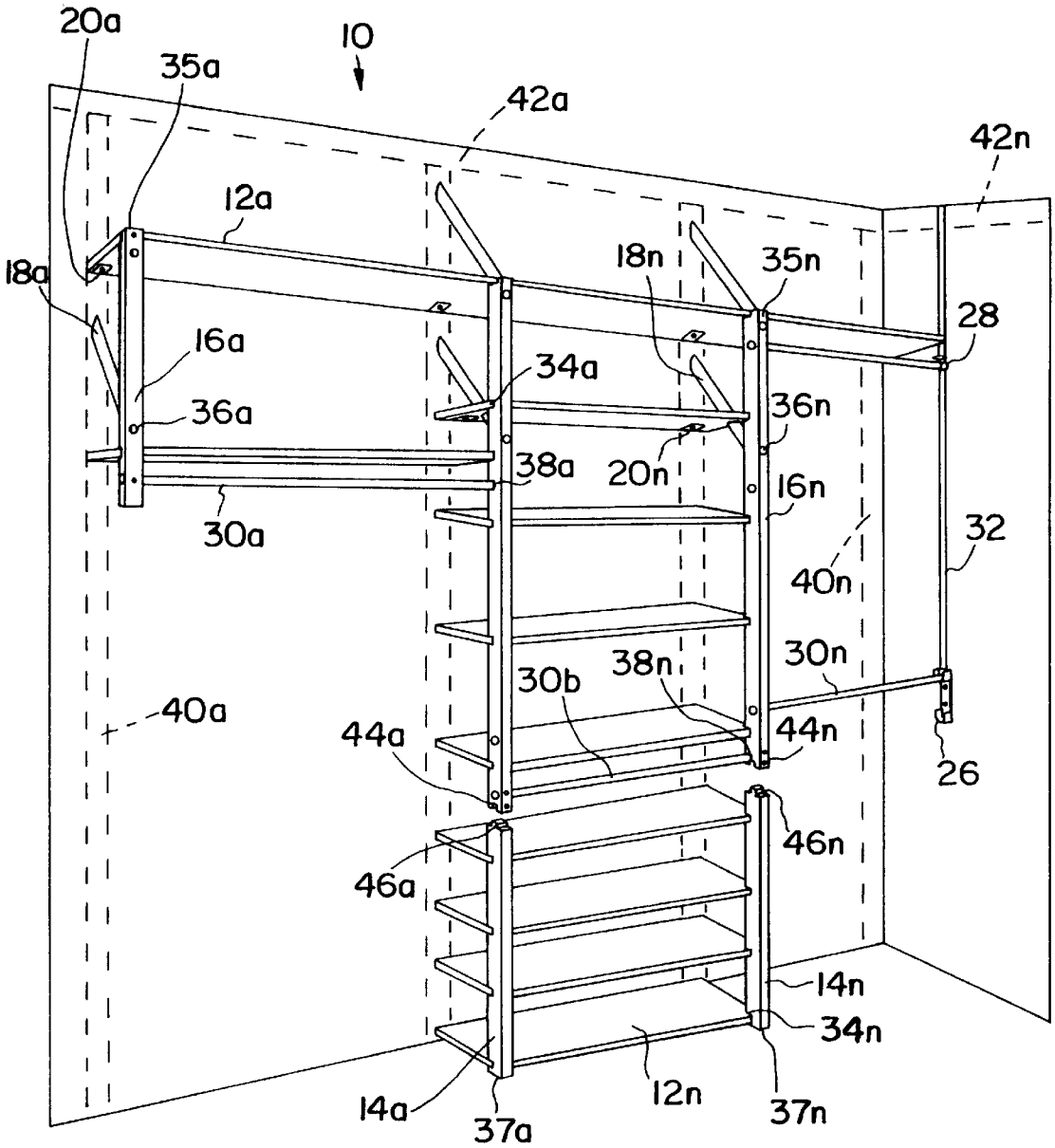
FIG. 1 illustrates an isometric view of a closet organizer suspension system, the present invention.
Figure 2A:
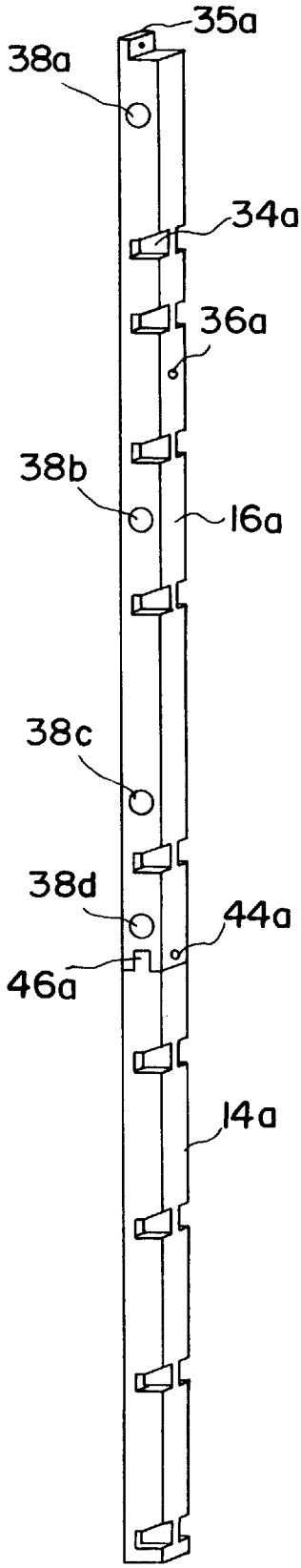
FIG. 2A illustrates a rear perspective view of a long upper notched vertical pole and a lower notched vertical pole.
Figure 2B:
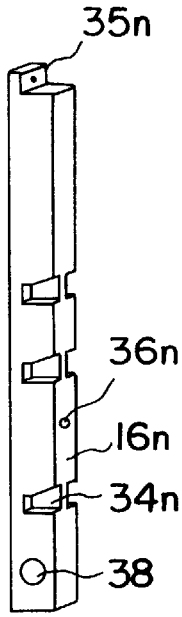
FIG. 2B illustrates a rear perspective view of a short upper notched vertical pole.
Figure 3:
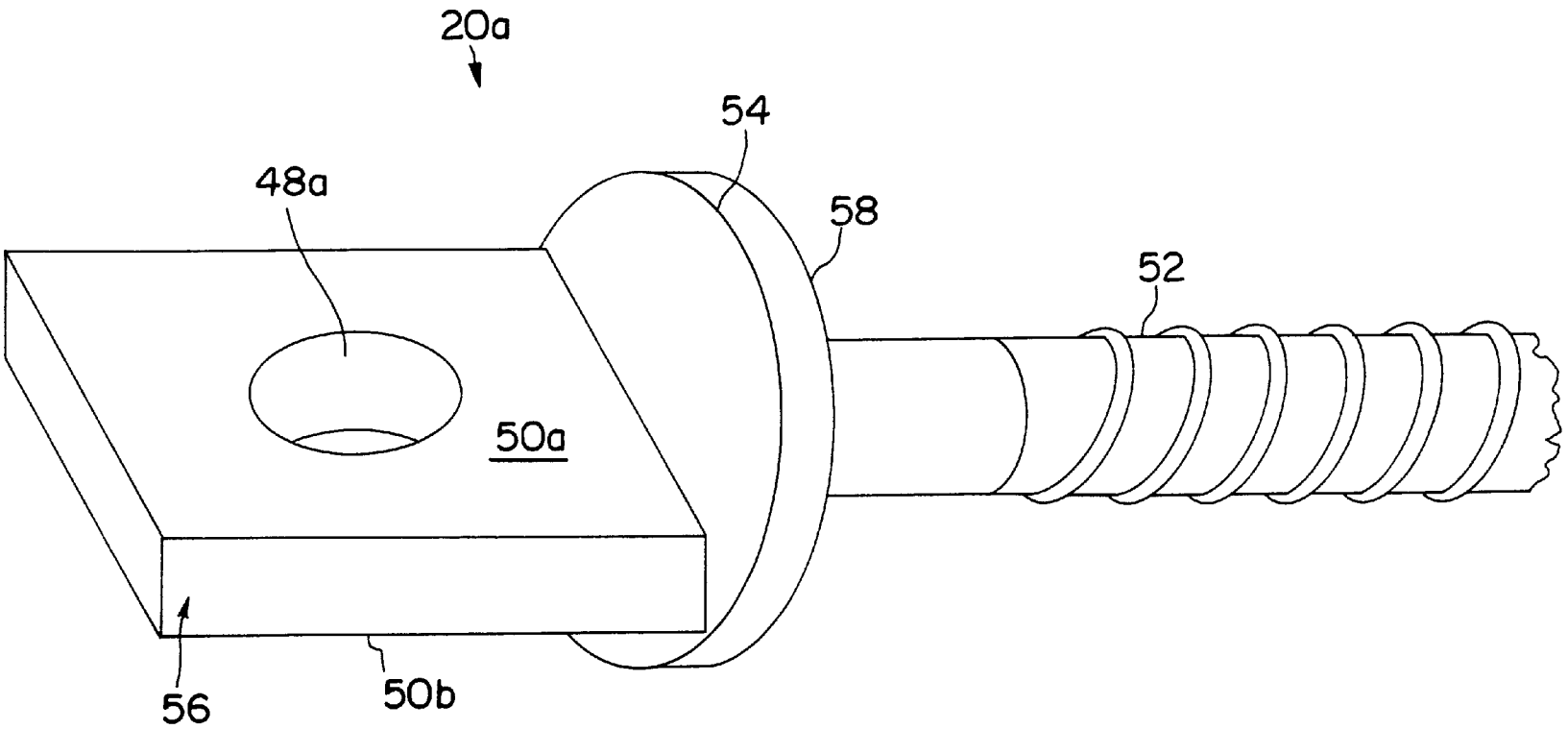
FIG. 3 illustrates a perspective view of a shelf support.

FIG. 1 illustrates an isometric view of a closet organizer suspension system 10, the present invention. The closet organizer suspension system 10 is comprised of a plurality of shelves 12*a*–12*n*, a plurality of lower notched vertical poles 14*a*–14*n*, a plurality of upper notched vertical poles 16*a*–16*n*, a plurality of tension rods 18*a*–18*n*, a plurality of shelf supports 20*a*–20*n*, a plurality of double-hang rod supports 26 (only one of which is illustrated), a plurality of single-hang rod supports 28 (only one of which is illustrated), a plurality of hanging rods 30*a*–30*n* and a plurality of tension straps 32 (only one of which is illustrated). With reference to FIGS. 2A and 2B, the lower notched vertical poles 14*a*–14*n* and the upper notched vertical poles 16*a*–16*n* are now described in detail. Each of the lower and upper notched vertical poles 14*a*–14*n* and 16*a*–16*n*, respectively, incorporates many of the same features, such as a plurality of notches 34*a*–34*n*, which support the front edges of the shelves 12*a*–12*n*, and a plurality of horizontal holes 38*a*–38*n*, which accommodate hanging rods 30*a*–30*n*. The lower and upper notched vertical poles 14*a*–14*n* and 16*a*–16*n* may be connected when the coupler ends 46*a*–46*n* meet receiver ends 44*a*–44*n* and are appropriately secured. The upper notched vertical poles 16*a*–16*n* incorporate L-shaped ends 35*a*–35*n* which accommodate the top shelf of the closet organizer suspension system 10 and secure thereto by means of appropriate fasteners such as, but not limited to, nails, screws and adhesives. In order to support the rear portions of the shelves 12*a*–12*n*, shelf supports 20*a*–20*n*, identical to shelf support 20*a* of FIG. 3, are screwed into studs 40*a*–40*n* so that one of the two flat sides is horizontal, at the height of the corresponding notches 34*a*–34*n*, which determine the shelf height. The front portions of shelves 12*a*–12*n* are then inserted at an angle into two corresponding notches 34*a*–34*n* and the shelf is lowered onto and rests upon the shelf supports 20*a*–20*n*. For additional structural integrity, screws may be inserted in the holes of the shelf supports 20*a*–20*n*; and shelves 12*a*–12*n* may be fastened not only to the shelf supports 20*a*–20*n* but also to the studs 40*a*–40*n*.

The lower notched vertical poles 14*a*–14*n* have flat ends 37*a*–37*n* which are suspended above the floor to allow the user of the closet organizer suspension system 10 to spray for insects and easily clean the space under the closet organizer suspension system 10. If the lower notched vertical poles 14*a*–14*n* are not used, the hanging rod 30*b* can be used for shorter garments.

Also illustrated is the use of a tension strap 32, which is made of metal or other suitable material, appropriately secured to the top plate 42*n* and which provides the ability to utilize a single-hang rod support 28 and a double-hang rod support 26 without the support of a stud. The tension strap 32 applies the load weight of the accessories attached therethrough to the top plate 42*n* rather than just the drywall. The accessories are screwed through the tension strap 32 and then into the drywall. Drywall anchors may also be used in conjunction with the tension strap 32 for additional support.

For even more support and strength, tension rods 18*a*–18*n* are inserted upwardly through angled holes 36*a*–36*n* and are screwed into the studs 40*a*–40*n*. At times, it may be necessary to drill angled holes through the shelves 12*a*–12*n* to make a clear path for the tension rods 18*a*–18*n* to pass through the shelves 12*a*–12*n* before securing to studs 40*a*–40*n*. The tension rods 18*a*–18*n* are then tightened until the shelves 12*a*–12*n* are level.

There is an unlimited number of possible configurations of the closet organizer suspension system 10, which allows the user to custom arrange the system to provide maximum use of the space it occupies.

Various pieces of custom hardware may be used in conjunction with the closet organizer suspension system 10 and are described below.

FIG. 2A illustrates a rear perspective view of a long upper notched vertical pole 16*a* and a lower notched vertical pole 14*a*, and FIG. 2B illustrates a rear perspective view of a short upper notched vertical pole 16*n*. Illustrated in particular are the pluralities of notches 34*a*–34*n*, horizontal holes 38*a*–38*n* and angled holes 36*a*–36*n*. Also illustrated is the interconnection of the upper and lower notched vertical poles 16*a* and 14*a*. This interconnection may be reinforced by gluing, screwing, nailing or other appropriate means of securement.

FIG. 3 illustrates a perspective view of a shelf support 20*a*. Now described in detail is the shelf support 20*a*. It is to be understood that shelf supports 20*b*–20*n*, not illustrated, are identical to shelf support 20*a*. Shelf support 20*a* is an adapted lag bolt having a flattened end 56 with planar surfaces 50*a* and 50*b* and a centrally located hole 48*a* opposite a standard lag bolt end 52 with an incorporated stop 54. The stop 54 provides a rear planar surface 58 which meets the drywall and provides a simple means for keeping the shelf supports 20*a*–20*n* all the same distance from the wall. Hole 48*a* accommodates a screw, nail or other fastener which passes upwardly through hole 48*a* and secures the lower planar surface of a shelf, which rests upon planar surface 50*a*. The shelf support 20*a* will function in the same manner if it is rotated 180°.

Figure 4:
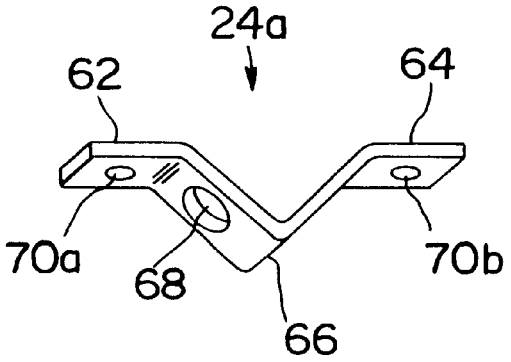
FIG. 4 illustrates a perspective view of a tension rod bracket.
Figure 5:
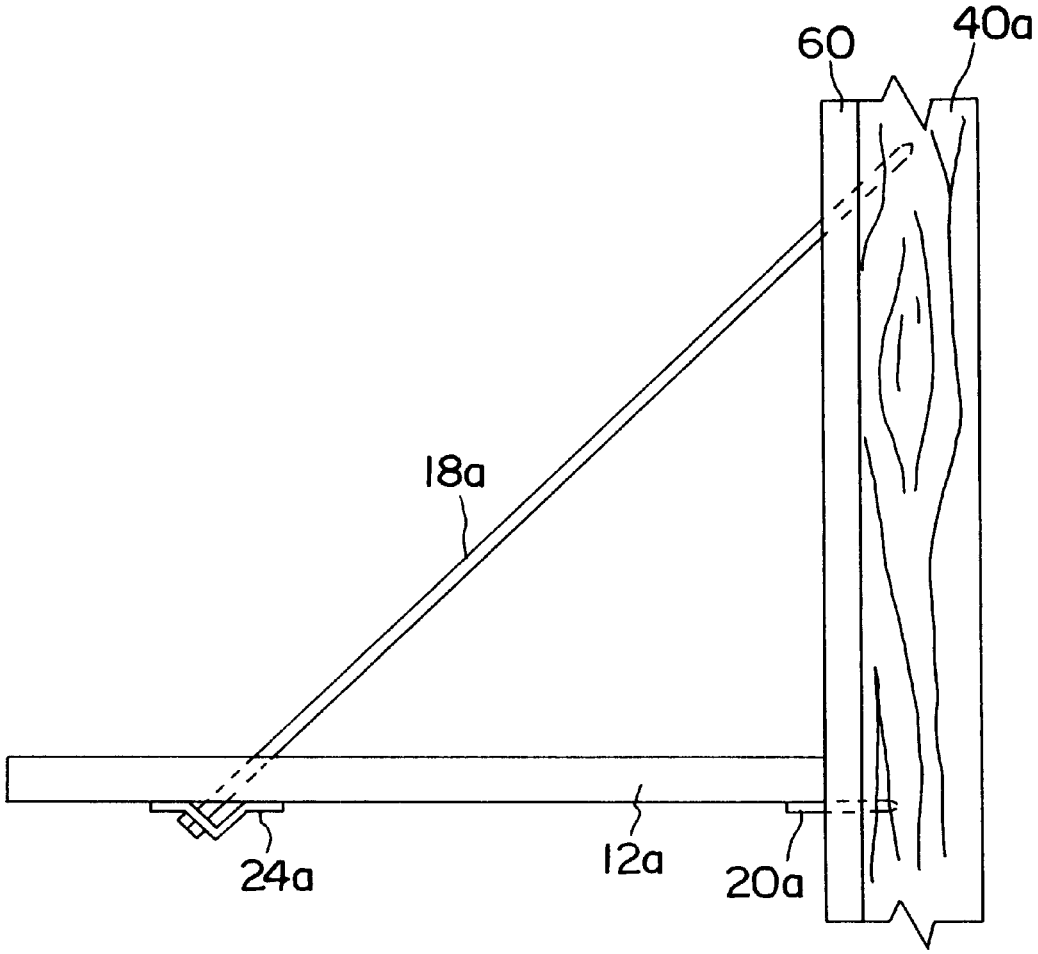
FIG. 5 illustrates a side view of a shelf support, a tension rod and a tension rod bracket in use supporting a shelf.

FIG. 4 illustrates a perspective view of a tension rod bracket 24*a*. With reference also to FIG. 5, the tension rod bracket 24*a* is now described in detail. The tension rod bracket 24*a* is used in conjunction with a tension rod 18*a* and a shelf 12*a*. The tension rod bracket 24*a* incorporates two planar portions 62 and 64 interrupted by a V-shaped portion 66. The planar portions 62 and 64 have centrally located holes 70*a* and 70*b*, respectively, which accommodate fasteners to secure the shelf 12*a* to the tension rod bracket 24*a*. The V-shaped portion 66 incorporates an angled hole 68 which accommodates a tension rod 18*a*. The use of tension rod bracket 24*a* is further described with reference to FIG. 5. It is to be understood that the closet organizer suspension system 10 may incorporate additional tension rod brackets 24*b*–24*n*, not illustrated, which are identical to tension rod bracket 24*a*.

FIG. 5 illustrates a side view of a shelf support 20*a*, a tension rod 18*a* and a tension rod bracket 24*a* in use supporting a shelf 12*a*. Shelf supports 20*a*–20*n* are screwed through the drywall 60 and into studs 40*a*–40*n* on a level horizontal plane. The shelf 12*a* then rests upon shelf supports 20*a*–20*n* and tension rod brackets 24*a*–24*n* are secured to the underside of shelf 12*a*. Illustrated in particular is the angle of tension rod 18*a* which passes upwardly through angled hole 68 of tension rod bracket 24*a*, through shelf 12*a* and is screwed through the drywall 60 and into the stud 40*a*. Alternatively, the tension rod 18*a* may be secured to one of the top plates 42*a*–42*n* which will also provide proper support as shown in FIG. 1. The tension rod 18*a* is then tightened until the shelf 12*a* is level. The tension rod 18*a* transfers much of the load weight of the shelf to the stud.

Figure 6:
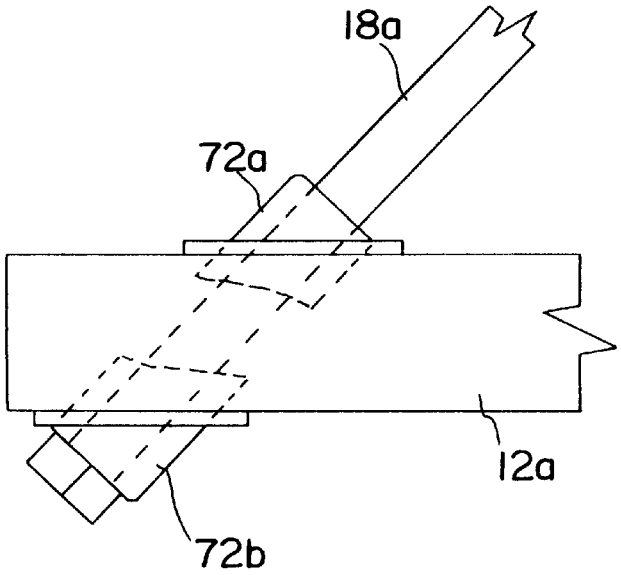
FIG. 6 illustrates a side view of a set of plastic grommets used as tension rod supports.

FIG. 6 illustrates a side view of a set of plastic grommets 72*a*–72*b* used in place of a tension rod bracket 24*a*. The plastic grommets 72*a*–72*b* are frictionally inserted into an angled hole drilled in shelf 12*a*, then the tension rod 18*a* is inserted through the plastic grommets 72*a*–72*b* and the shelf 12*a*, and the tension rod 18*a* is then screwed into the stud. This configuration acts in a similar fashion to that described with reference to FIG. 5.

Figure 7:
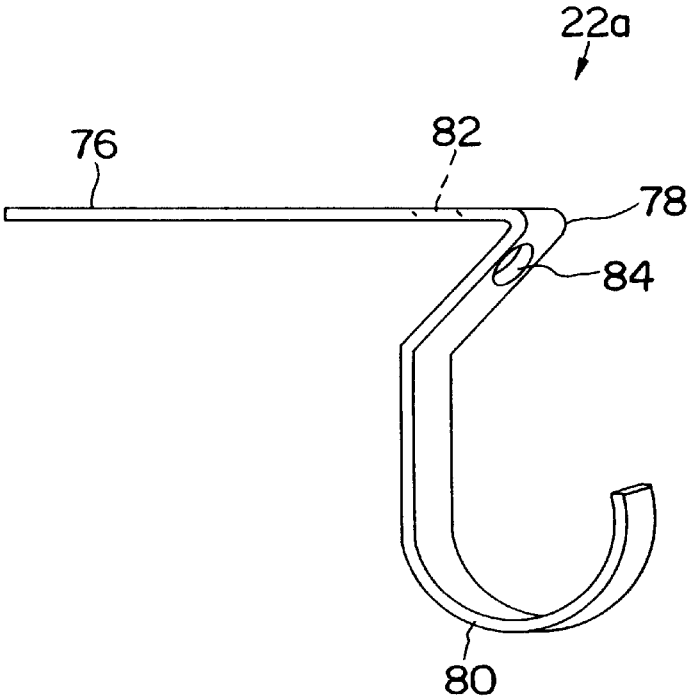
FIG. 7 illustrates a perspective view of a hooked tension rod bracket.
Figure 8:
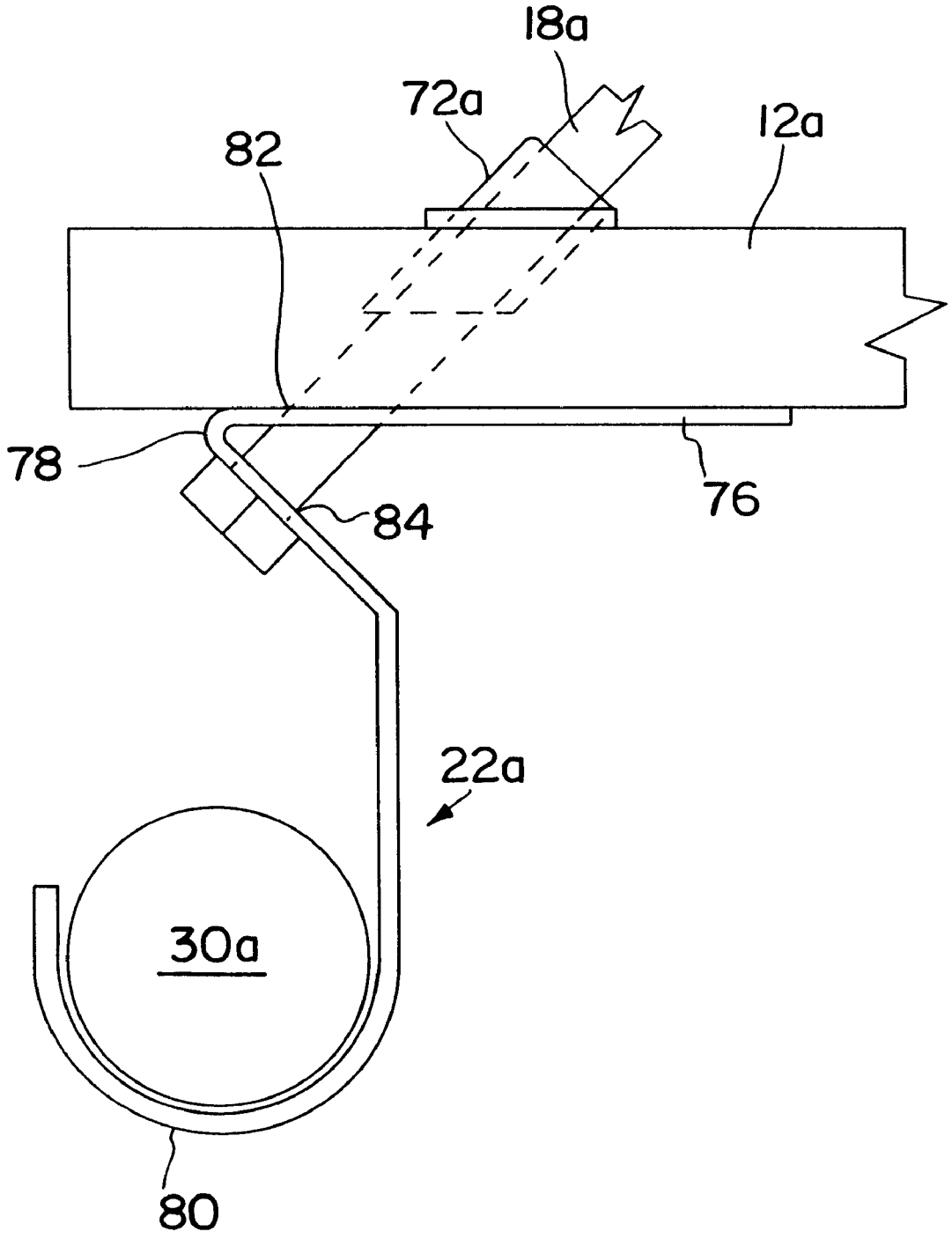
FIG. 8 illustrates a side view of a hooked tension rod bracket in use.

FIG. 7 illustrates a perspective view of a hooked tension rod bracket 22*a*. With reference also to FIG. 8, the hooked tension rod bracket 22*a* is now described in detail. The hooked tension rod bracket 22*a* is used in conjunction with a tension rod 18*a* and a shelf 12*a*. The hooked tension rod bracket 22*a* incorporates an upper planar portion 76 and an angled bend 78 which extends downwardly and inwardly to a hook portion 80 which gravitationally receives a hanging rod 30*a*. Angled holes 82 and 84 through the planar portion 76 and the angled bend 78 accommodate the tension rod 18. The use of hooked tension rod bracket 22*a* is further described with reference to FIG. 8. It is to be understood that the closet organizer suspension system 10 may incorporate additional hooked tension rod brackets 22*b*–22*n*, not illustrated, which are identical to hooked tension rod bracket 22*a*.

FIG. 8 illustrates a side view of a hooked tension rod bracket 22*a* in use. The tension rod 18*a* is inserted through the angled holes 82 and 84 of hooked tension rod bracket 22*a*, through the shelf 12*a* and a plastic grommet 72*a* (if needed), and then is screwed into the stud. The hook portion 80 gravitationally receives a hanging rod 30*a*. This configuration acts in a similar fashion to that described with reference to FIG. 5.

Figure 9:
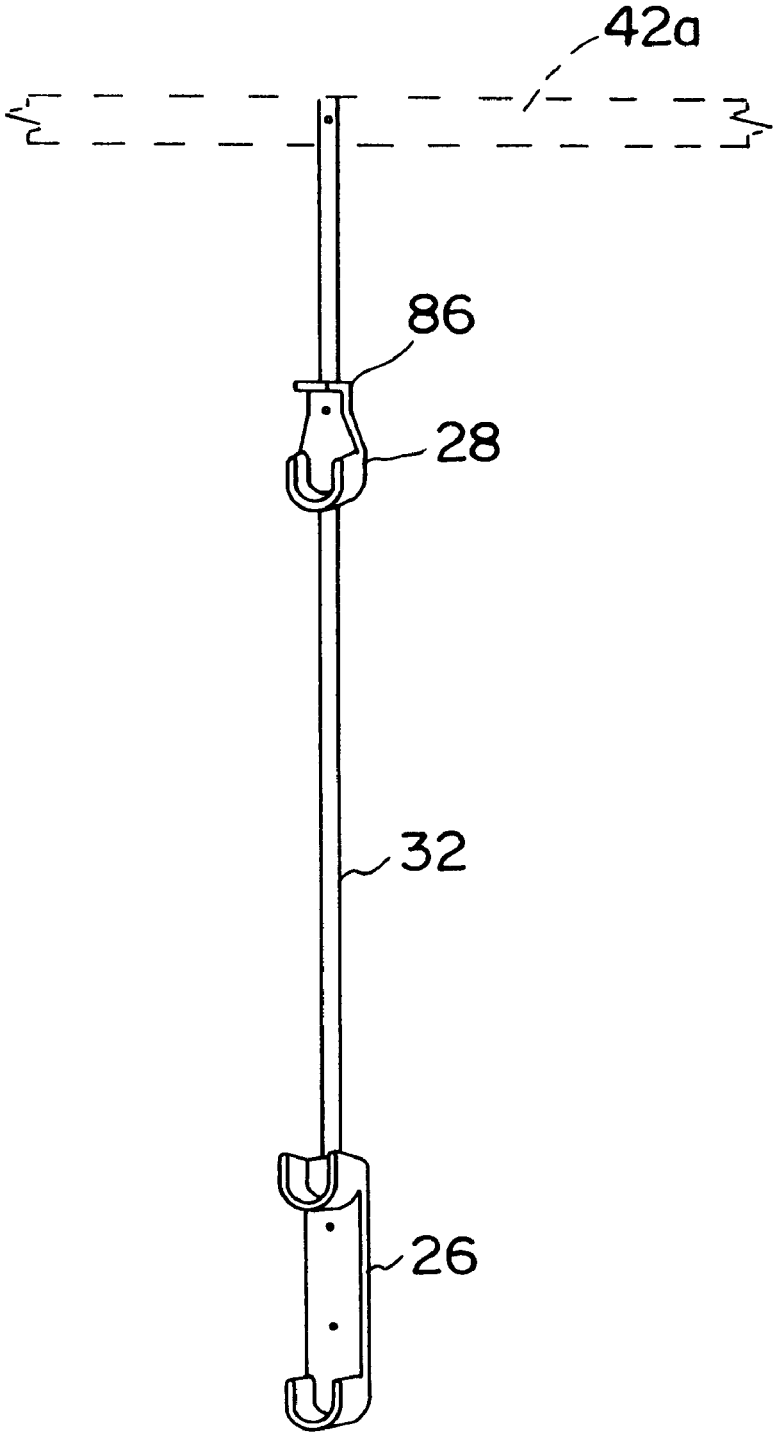
FIG. 9 illustrates the single-hang and double-hang rod supports.

FIG. 9 illustrates the single-hang and double-hang rod supports 28 and 26 used with a tension strap 32 secured to a top plate 42*a*. Illustrated in particular is the single-hang rod support 28, which receives a hanging rod 30*a*–30*n* and which incorporates a shelf support end 86 which extends outwardly at a right angle to support the side of a shelf near the front on a wall where studs are not available. The tension strap 32 transfers the shelf load weight to the top plate 42*a*. The double-hang rod support 26 allows the user to easily adjust the height of a hanging rod 30*a*–30*n*. Both the single-hang and double-hang rod supports 28 and 26 are screwed through the tension strap 32 and drywall and into the stud. Drywall anchors may be used between the tension strap 32 and the drywall for additional strength and support. Although only one single-hang rod support 28, double-hang rod support 26, and tension strap 32 is shown in the closet organizer suspension system 10 illustrated in FIG. 1, it is to be understood that any number thereof may be employed depending on the configuration and arrangement desired.

Figure 10A:
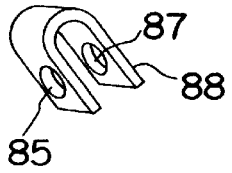
FIGS. 10A and 10B illustrate, respectively, perspective views of a wire shelf support and a hooked wire shelf support, the first alternative embodiment.
Figure 10B:
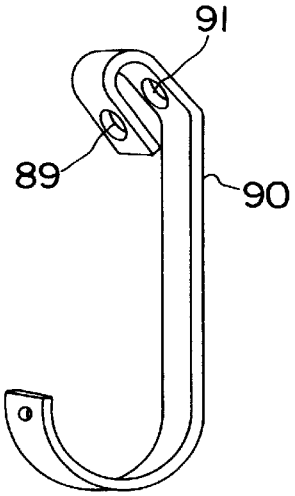
Figure 11:
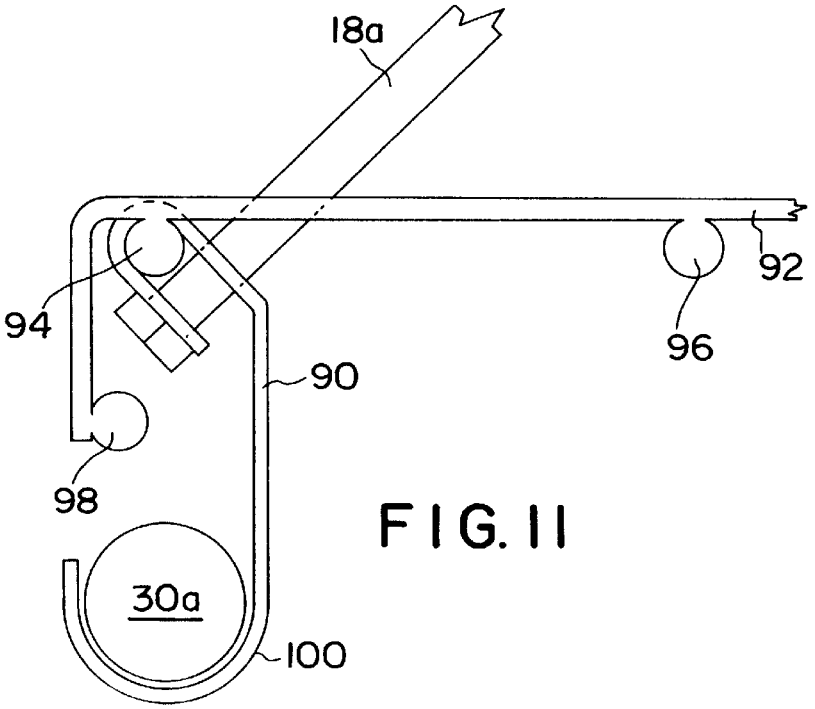
FIG. 11 illustrates a side view of a hooked wire shelf support in use.

FIGS. 10A and 10B illustrate, respectively, perspective views of a wire shelf support 88 and a hooked wire shelf support 90, the first alternative embodiment, and FIG. 11 illustrates a side view of the hooked wire shelf support 90 in use. With reference to FIGS. 10A, 10B and 11, the wire shelf support 88 has holes 85 and 87 and functions similarly to the tension rod brackets 24*a*–24*n* and plastic grommets 72*a* and 72*b*; and the hooked wire shelf support 90 has holes 89 and 91 and functions similarly to the hooked tension rod brackets 22*a*–22*n*, but this adaptive hardware allows the support method and properties of the preferred embodiment to be adapted for use with existing wire shelving.

With reference to FIG. 11, the use of the hooked wire shelf support 90 is now described. A wire shelf 92, having wire cross members 94,96 and 98, is engaged by the hooked wire shelf support 90, and a tension rod 18*a* is inserted through the holes 89 and 91 in the hooked wire shelf support 90 and extended upwardly at an angle and into a stud or top plate. The hooked wire shelf support 90 captures cross member 94 and the tension rod 18*a* secures the hooked wire shelf support 90 about cross member 94, providing the wire shelf 92 with a heavier load capacity. A hooked portion 100 of hooked wire shelf support 90 accommodates a hanging rod 30*a*, as illustrated. It is to be understood that the wire shelf support 88 may be substituted for the hooked wire shelf support 90 for use without a hanging rod.

Figure 12:
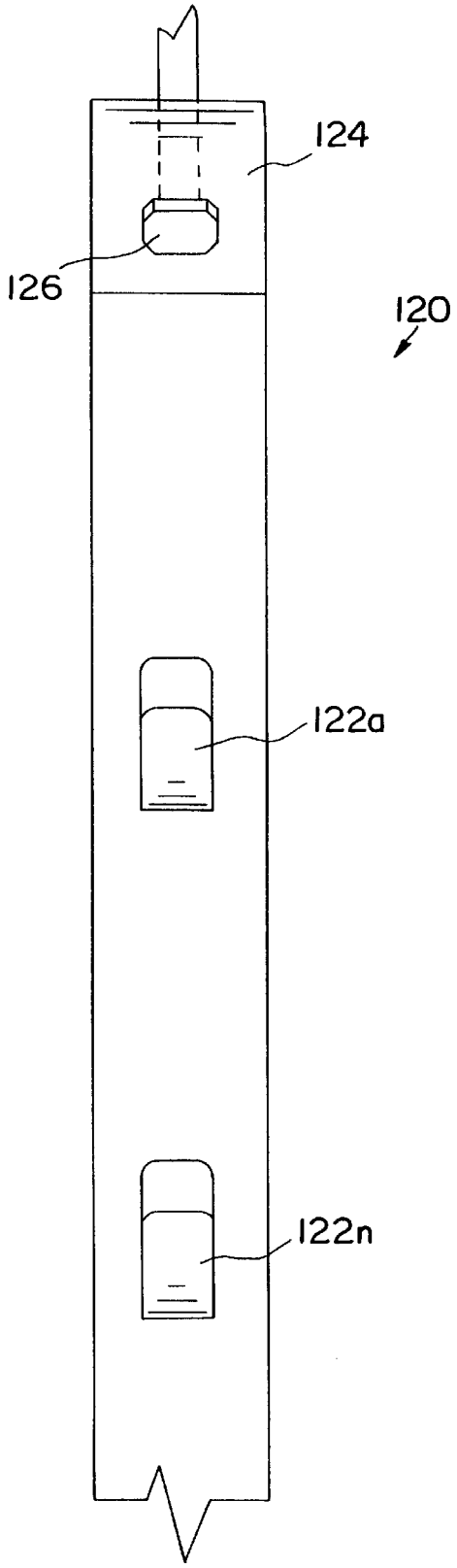
FIG. 12 illustrates a front view of a wire shelf reinforcement.

FIG. 12 illustrates a front view of a wire shelf reenforcement 120 which is made of a relatively thin strip of metal having a plurality of hook-shaped tabs 122*a*–122*n* evenly spaced along its length and extending outwardly therefrom. Hook-shaped tabs 122*a*–122*n* accommodate the cross members of already existing wire shelving. The top of the wire shelf reenforcement 120 has a U-shaped hook 124 which accommodates a tension rod 126 angled upwardly. The wire shelf reenforcement 120 is used to transfer loads of already existing wire shelves to a stud or top plate and will be further described with reference to FIG. 13.

Figure 13:
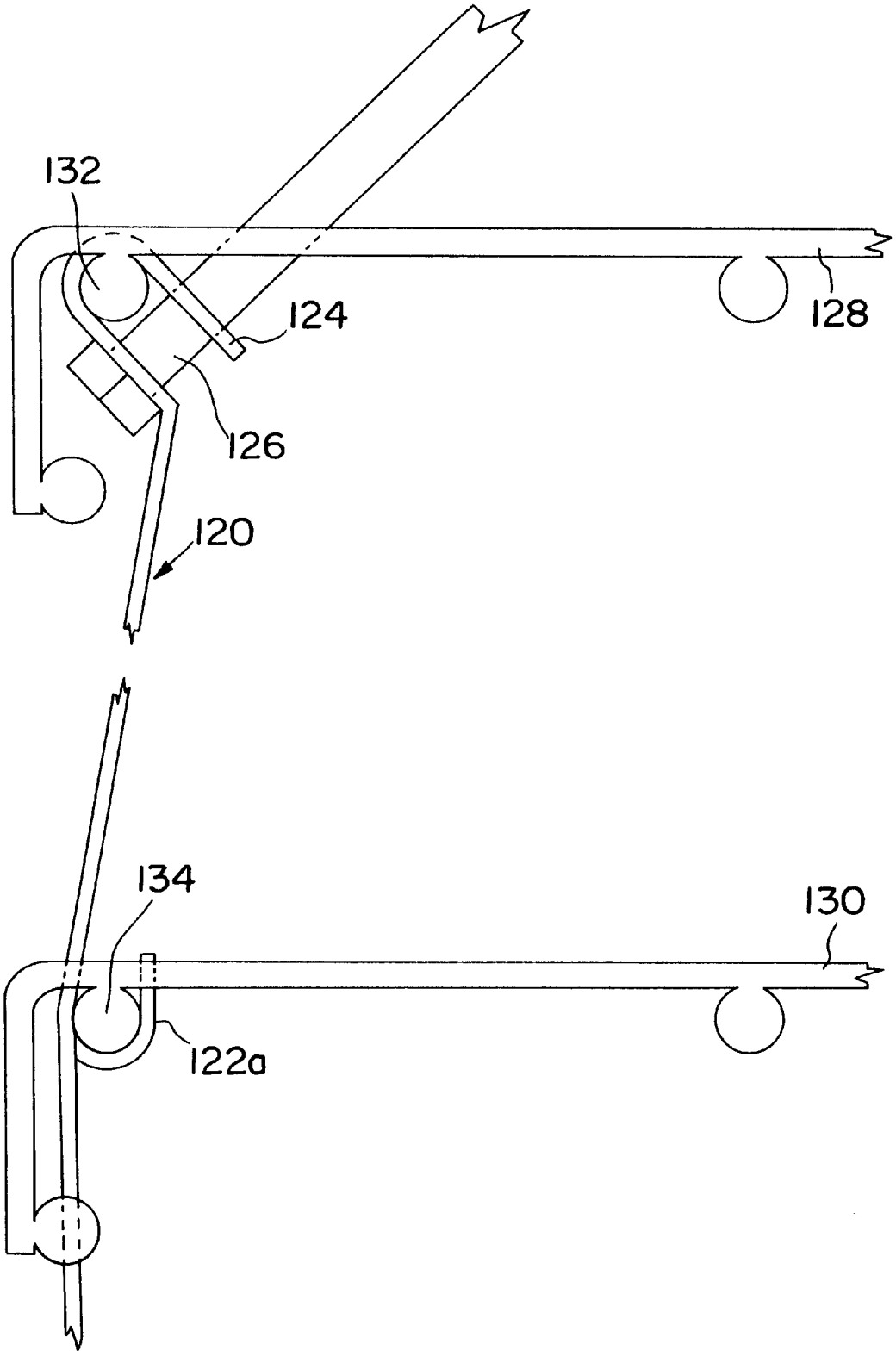
FIG. 13 illustrates a side view of a wire shelf reinforcement in use.

FIG. 13 illustrates a side view of a wire shelf reenforcement 120 in use. Illustrated are two wire shelves 128 and 130, which are identical to and have similar features as wire shelf 92, including cross members 132 and 134. Illustrated in particular is the U-shaped hook 124 of wire shelf reenforcement 120 engaged over and about cross member 132 and secured thereto by tension rod 126. Tension rod 126 is angled upwardly and secured to a stud or top plate, and is tightened until the wire shelf 128 is level. The wire shelf reenforcement 120 continues downwardly where hook-shaped tab 122*a* gravitationally captures cross member 134 of wire shelf 130. The wire shelf reenforcement 120 then continues downwardly where hook-shaped tabs 122*b*–122*n*, not illustrated, capture the cross members of other existing wire shelves. It is to be understood that at least two of the wire shelf reenforcements 120 are used for maximum stability, and each of the plurality of hook-shaped tabs 122*a*–122*n* may or may not capture a wire shelf cross member, depending on the configuration of wire shelving.

Figure 14:
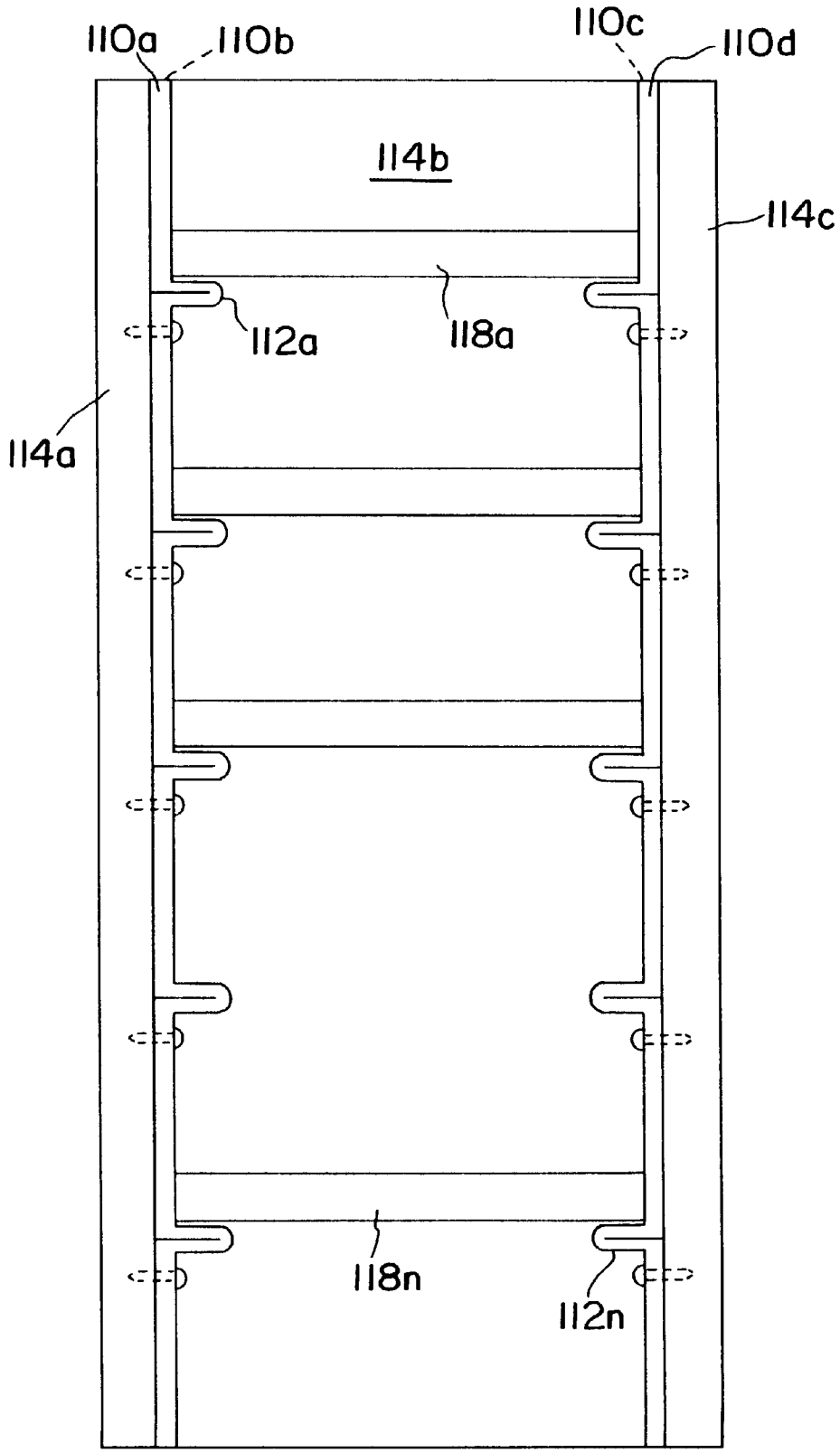
FIG. 14 illustrates a front view of multiple shelf supports in use, the second alternative embodiment.

FIG. 14 illustrates a front view of multiple shelf supports 110*a*–110*d* in use. This illustration represents a pantry or linen closet where the components illustrated are exaggerated for clarity. The multiple shelf supports 110*a*–110*d* are made of thin, very strong strips of metal which will not easily bend. It is to be understood that the multiple shelf supports 110*a*–110*d* may be made of plastic or other suitable material. Each of the multiple shelf supports 110*a*–110*d* is comprised of a thin strip of metal which at intervals is bent outwardly at a 90° angle, extends out approximately one inch and then is bent inwardly 180°, extends back approximately one inch and then is bent back 90°, creating a series of horizontal lips 112*a*–112*n*. Horizontal lips 112*a*–112*n* are evenly spaced and extend outwardly along the multiple shelf supports 110*a*–110*d*. Beneath each horizontal lip 112*a*–112*n* holes are provided to accommodate screws for securing the multiple shelf supports 110*a*–110*d* to the studs. If studs are not available, drywall anchors can be used.

Inside a linen or pantry closet, the multiple shelf supports 110*b* and 110*c* are secured to the inside corner studs, facing either outward from wall 114*b* or outward from walls 114*a* and 114*c*. Multiple shelf supports 110*a* and 110*d* are secured to the studs of walls 114*a* and 114*c*. The multiple shelf supports 110*b* and 110*c* are aligned directly behind multiple shelf supports 110*a* and 110*d*. Once four multiple shelf supports 110*a*–110*d* are properly leveled, aligned, spaced, and secured, shelves 118*a*–118*n* rest upon the horizontal lips 112*a*–112*n* and butt against the back wall 114*b*. The plurality of horizontal lips 112*a*–112*n* allows the user to select which heights the shelves should be placed for maximum storage. The user may opt to skip a set of horizontal lips 112*a*–112*n* in order to accommodate larger items. The existing shelving systems incorporate pluralities of vertically aligned holes and corresponding pegs which are used to support the shelves. The multiple shelf supports 110*a*–110*d* have no loose parts to be lost or knocked off and improve on the current systems by providing a shelf system which takes up less space and eliminates the need for a shelving framework and pegs.

Figure 15:
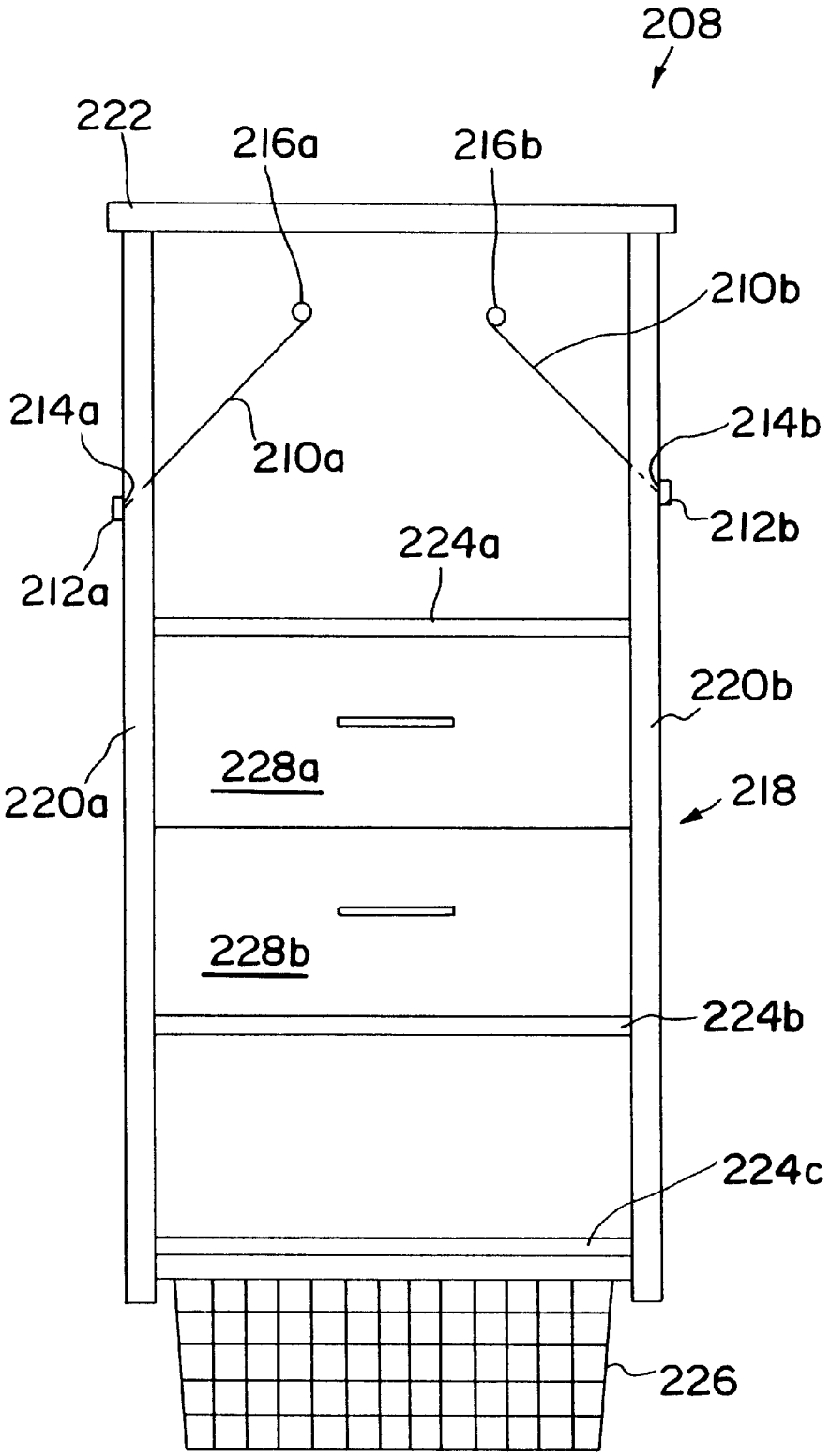
FIG. 15 illustrates a front view of an internal suspension system, the third alternative embodiment.

FIG. 15 illustrates a front view of an internal suspension system 208, the third alternative embodiment. The internal suspension system 208 secures a framework 218 having a top 222, two side panels 220*a*–220*b*, shelves 224*a*–224*c*, drawers 228*a*–228*b* and a basket 226. The appropriate hardware for the drawers 228*a*–228*b* and basket 226 is secured to the side panels 220*a*–220*b* of the framework 218. The number and configurations of the shelves, drawers and baskets are custom designed to the needs of the user.

The framework 218 is suspended by means of a pair of lag bolts 216*a*–216*b*, a pair of cables 210*a*–210*b* and a pair of stops 212*a*–212*b*. The stops 212*a*–212*b* are attached to the outer ends of cables 210*a*–210*b*. The opposite ends of the cables 210*a*–210*b* are secured to lag bolts 216*a*–216*b*, which are then partially screwed into the studs of a wall. The attached stops 212*a*–212*b* are inserted through two holes 214*a*–214*b* in the side panels 220*a*–220*b* of framework 218, located near the wall. Lag bolts 216*a*–216*b* are then tightened or loosened until the framework 218 is level. Shelves 224*a* and 224*c* are secured to the studs of the back wall using a plurality of shelf supports 20*a*–20*n*, not illustrated. This adds more stability and a higher shelf load capacity. The weight of the framework 218, its components and shelf load frictionally secure the framework 218 to the wall studs. The lag bolts 216*a*–216*b*, the cables 210*a*–210*b* and the stops 212*a*–212*b* are illustrated on the interior of framework 218, but it is to be understood that the suspension system will function in the same manner if the components are used on the exterior of framework 218.

Figure 16:
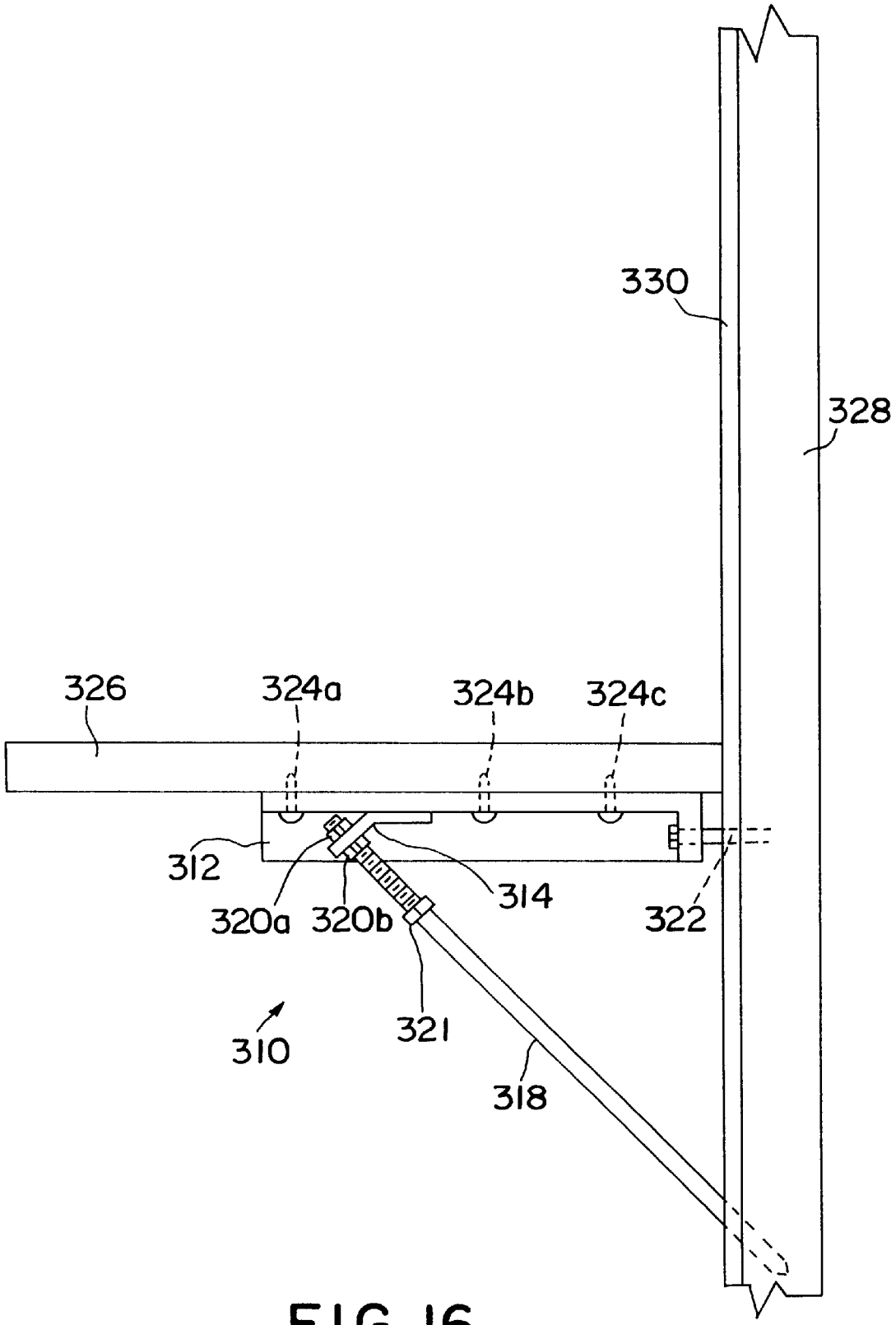
FIG. 16 illustrates a side view of a desktop support system, the fourth alternative embodiment; and, FIG. 17 illustrates a side view of a scribing bracket.

FIG. 16 illustrates a side view of a desktop support system 310, the fourth alternative embodiment. The desktop support system 310 is comprised of a support bracket 312 having an angled flange 314, a threaded compression rod 318, two nuts 320*a*–320*b*, a lag bolt 322, a plurality of screws 324*a*–324*c* and a desktop 326. Illustrated is one support bracket 312 and its corresponding components, but it is to be understood that the number of support brackets is dependent on the length of the desktop.

To install the desktop support system 310, compression rod 318 is partially screwed into stud 328, then the angled flange 314 of support bracket 312 is inserted over and about compression rod 318. Compression rod 318 incorporates a fixed nut 321 which is used to easily screw the compression rod 318 into the stud 328 with a wrench or deep well socket. Lag bolt 322 then passes through support bracket 312, drywall 330 and is loosely secured to stud 328. The desktop 326 is now positioned on support bracket 312 and aligned snug with the drywall 330, leaving a space between support bracket 312 and drywall 330. The desktop 326 is then secured to support bracket 312 by means of screws 324*a*–324*c*. Lag bolt 322 is now tightened, which pulls the drywall 330 and stud 328 to the desktop 326, eliminating the need for scribing the desktop to the wall.

Compression rod 318 adds support to desktop 326 and is now adjusted by tightening and loosening nuts 320*a*–320*b* until the desktop 326 is level.

Figure 17:
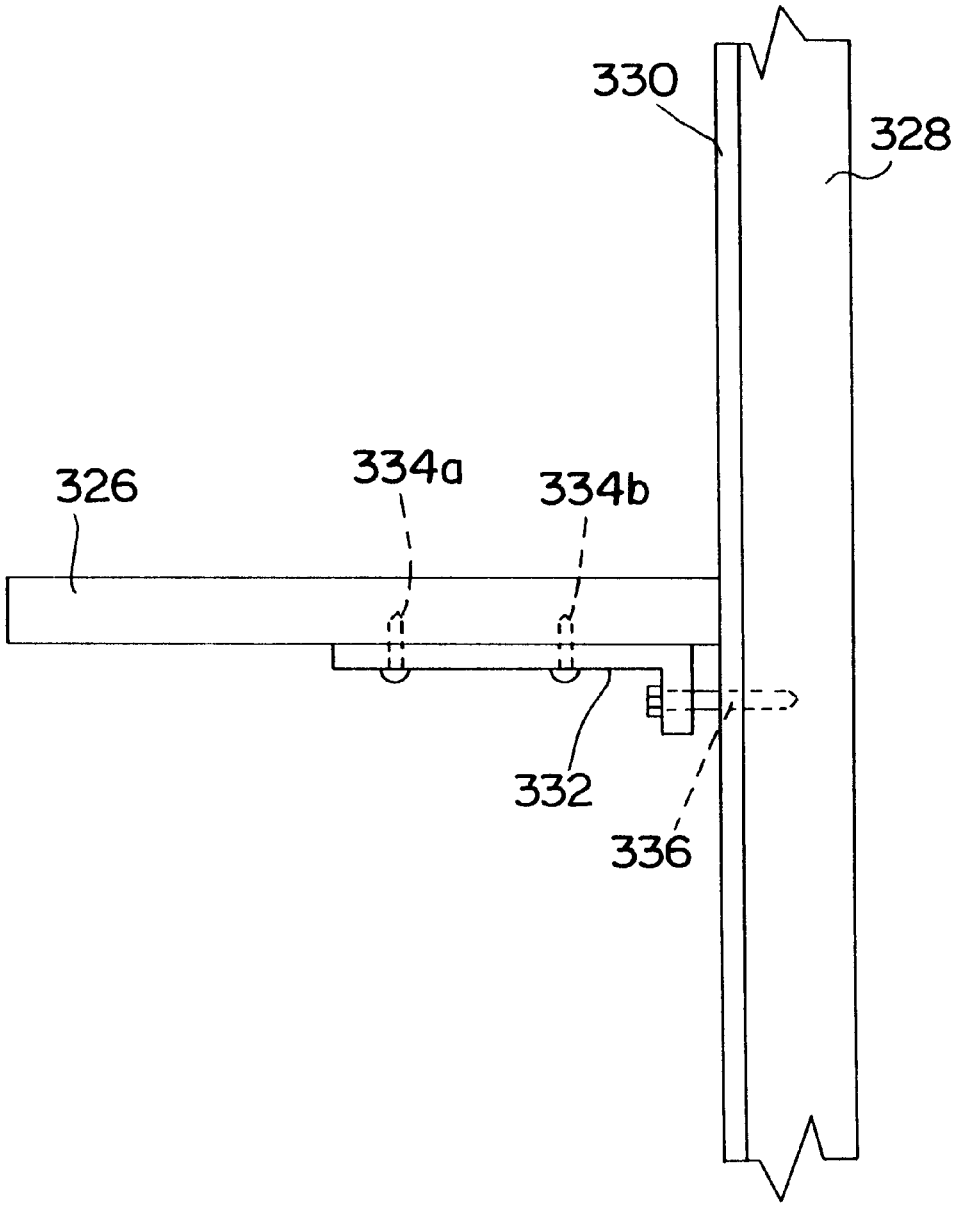

FIG. 17 illustrates a side view of a scribing bracket. The scribing bracket 332 is an angled strip of metal shorter in length than support bracket 312. The scribing bracket 332 is illustrated as a bent strip of metal, but it is to be understood that the scribing bracket 332 may be constructed of angle iron or other suitable material. Scribing bracket 332 is installed by partially screwing lag bolt 336 into stud 328, then desktop 326 is aligned atop scribing bracket 332 abutting drywall 330. The desktop is then secured to scribing bracket 332 by means of screws 334*a* and 334*b*, leaving a space between the scribing bracket 332 and drywall 330. Lag bolt 336 is then tightened to pull the stud 328 outwardly, causing the drywall 330 to become snug against desktop 326.

The scribing bracket 332 is used intermittently between support brackets 312 to pull the wall toward the desktop 326, where scribing would typically be necessary. The combination of the support brackets 312 and scribing brackets 332 creates the ability to secure the desktop 326 snugly against an imperfect wall by slightly pulling the studs of the wall outward with the lag bolts pulling the desktop 326 toward the wall, creating a very stable and level work surface.

Various modifications can be made to the present invention without departing from the apparent scope hereof.

CLOSET ORGANIZER SUSPENSION SYSTEM

PARTS LIST

| | | | |
|---|---|---|---|
| 10 | closet organizer suspension system | 40a-n | studs |
| 12a-n | shelves | 42a-n | top plates |
| 14a-n | lower notched vertical poles | 44a-n | receiver ends |
| 16a-n | upper notched vertical poles | 46a-n | coupler ends |
| 18a-n | tension rods | 48a | hole |
| 20a-n | shelf supports | 50a-b | planar surfaces |
| 22a-n | hooked tension rod brackets | 52 | lag bolt end |
| 24a-n | tension rod brackets | 54 | stop |
| 26 | double-hang rod support | 56 | flattened end |
| | | 58 | rear planar surface |
| | | 60 | drywall |
| | | 62 | planar portion |
| | | 64 | planar portion |
| | | 66 | V-shaped portion |

-continued

PARTS LIST

| | | | |
|---|---|---|---|
| 28 | single-hang rod support | 68 | angled hole |
| 30a-n | hanging rods | 70a-b | holes |
| 32 | tension strap | 72a-b | plastic grommets |
| 34a-n | notches | 76 | planar portion |
| 35a-n | L-shaped ends | 78 | angled bend |
| 36a-n | angled holes | 80 | hook portion |
| 37a-n | flat ends | 82 | angled hole |
| 38a-n | horizontal holes | 84 | angled hole |
| 88 | wire shelf support | 85 | hole |
| 89 | hole | 86 | shelf support end |
| 90 | hooked wire shelf support | 87 | hole |
| 91 | hole | 212a-b | stops |
| 92 | wire shelf | 214a-b | holes |
| 94 | cross member | 216a-b | lag bolts |
| 96 | cross member | 218 | framework |
| 98 | cross member | 220a-b | side panels |
| 100 | hooked portion | 222 | top |
| 110a-d | multiple shelf supports | 224a-c | shelves |
| 112a-n | horizontal lips | 226 | basket |
| 114a-c | walls | 228a-b | drawers |
| 118a-n | shelves | 310 | desktop support system |
| 120 | wire shelf reenforcement | 312 | support bracket |
| 122a-b | hook-shaped tabs | 314 | angled flange |
| 124 | U-shaped hook | 318 | compression rod |
| 126 | tension rod | 320a-b | nuts |
| 128 | wire shelf | 321 | fixed nut |
| 130 | wire shelf | 322 | lag bolt |
| 132 | cross member | 324a-c | screws |
| 134 | cross member | 326 | desktop |
| 208 | internal suspension system | 328 | stud |
| 210a-b | cables | 330 | drywall |
| | | 332 | scribing bracket |
| | | 334a-b | screws |
| | | 336 | lag bolt |

What is claimed is:

1. A closet organizer suspension system, comprising:

a. at least one planar shelf board, said at least one planar shelf board having an upper surface, a lower surface, a front edge, a rear edge, and two side edges;

b. a plurality of shelf supports each having a first end having a pointed tip for penetrating a wall stud and a second end having a planar surface for engaging the lower surface of a said planar shelf board adjacent to the rear edge of the planar shelf board;

c. a plurality of vertical poles each having a front surface, a rear surface, two side surfaces, an upwardly slanting hole extending from said front surface to said rear surface, and at least one notch in a side surface that opens to said rear surface for receiving a portion of a side edge and a portion of the front edge of a said planar shelf board; and, d. a plurality of tension rods for extending through said upwardly slanting holes in said vertical poles, each of said tension rods having a pointed tip at one end for penetrating a wall stud and an enlarged head at the other end for acting against the front surface of a said vertical pole.

2. A closet organizer suspension system according to claim 1, wherein each of said vertical poles has a plurality of upwardly slanting holes extending from said front surface to said rear surface, each of said upwardly slanting holes being for receiving a tension rod.

3. A closet organizer suspension system according to claim 1, wherein each of said vertical poles has a plurality of notches in a side surface that open to said rear surface, each of said notches being for receiving a portion of a side edge and a portion of the front edge of a said planar shelf board.

4. A closet organizer suspension system according to claim 1, wherein at least some of said vertical poles comprise an upper portion and a lower portion removably coupled together.

5. A closet organizer suspension system according to claim 1, and further including at least one hanging rod extending between adjacent vertical poles.

6. A closet organizer suspension system according to claim 1, and further including a tension strap incorporating a single-hang rod support and a double-hang rod support.

* * * * *